United States Patent [19]

Wilson

[11] 4,239,223

[45] Dec. 16, 1980

[54] NOVELTY GAME DRINKING GLASS

[76] Inventor: Michael C. Wilson, 735 Forest Ave., Glen Ellyn, Ill. 60137

[21] Appl. No.: 870,948

[22] Filed: Jan. 20, 1978

[51] Int. Cl.[3] ..... A63F 5/02

[52] U.S. Cl. ..... 273/138 R; 40/324; 273/115; 273/145 C

[58] Field of Search ..... 273/138 R, 144 B, 145 R, 273/145 A, 145 C, 145 CA, 147; 215/10; 206/508, 315 R, 315 B; 46/116, 175 R; 40/324, 10 D

[56] References Cited

U.S. PATENT DOCUMENTS

| | | | |
|---|---|---|---|
| 777,305 | 12/1904 | Priestnall | 40/324 |
| 933,429 | 9/1909 | Gitterman | 273/145 C |
| 1,629,142 | 5/1927 | Bonell | 273/145 A |
| 2,035,638 | 3/1936 | Culp | 273/138 R |
| 2,310,420 | 2/1943 | Graham | 206/508 |
| 2,463,298 | 3/1949 | Nagel et al. | 273/138 R X |
| 2,601,985 | 7/1952 | Yerkes | 273/138 R X |
| 3,690,668 | 9/1972 | Weeks et al. | 273/138 R |

FOREIGN PATENT DOCUMENTS

| | | | |
|---|---|---|---|
| 823992 | 12/1951 | Fed. Rep. of Germany | 273/145 C |
| 363674 | 10/1938 | Italy | 273/145 C |
| 220376 | 8/1924 | United Kingdom | 273/145 C |
| 530100 | 12/1940 | United Kingdom | 273/138 R |
| 542325 | 1/1942 | United Kingdom | 273/145 A |
| 884838 | 12/1961 | United Kingdom | 273/138 R |
| 1418690 | 12/1975 | United Kingdom | 273/138 R |

*Primary Examiner*—Richard C. Pinkham
*Assistant Examiner*—Arnold W. Kramer
*Attorney, Agent, or Firm*—Alter and Weiss

[57] ABSTRACT

A novelty game drinking glass for containing beverages as well as entertaining, amusing and interesting the user. The glass itself has a transparent partition positioned upwardly from the bottom end to form a bottom recess portion at the bottom end. A novelty game is positioned into this bottom recess so as to be visible by a user through the transparent partition and the novelty game is restrainably positioned on the bottom by a recess closure which also provide a liquid-tight seal to the bottom recess portion.

12 Claims, 12 Drawing Figures

NOVELTY GAME DRINKING GLASS

BACKGROUND OF THE INVENTION

The present invention reletes in general to functional novelty devices and in particular to novelty game drinking glass devices.

While amusement type games have been incorporated with many types of functional housewares, sporting goods and the like, relatively few novelty game devices have been directed for utilization with drinking glasses. Among these few are U.S. Pat. Nos. 2,598,019; 2,700,249; 2,945,314; and 3,188,040.

Of those devices which have attempted to incorporate games into combination with houseware items such as glassware, many have been confronted with problems which to date have not been resolved. Among these problems has been the difficulty in converting games with which people are familiar, to an easy-to-play alternative game having a minimum number of moving or cooperating parts. For example, an attempt to include a roulette-type game into a houseware item could require the utilization of a pinned connection with a rotating center member as well as a rotating outer member capable of rotation in an opposite direction to the inner portion.

Additionally, many of these inventions find it difficult, if not impossible, to incorporate the game portion of the device integrally into the glass itself, but rather utilize any game features in a separate, removeable coaster. This is often done to get around the problems associated with depositing the game itself into an automatic dishwasher or submerging it in a sink only to find that the "false bottom" compartment leaks due to ineffective sealing The utilization of pins or rivots, of course, would be extremely detrimental to any game within such a false bottom.

Accordingly, one of the objects of the present invention is to convert games of which many, if not most, people are familiar, into easily playable games requiring a minimum number of functioning elements.

Additionally, it is an object of the present invention to provide an integrated game-glass assembly without the need for detachable independent units which need to be separated when the glass portion, for example, needs to be washed.

Further, it is the object of the present invention to provide a durable novelty game glass device with an improved water tight seal so as to preclude any possibility of damaging the game portion of the device while eliminating the need for pinned or rivoted elements.

Also it is an object of the present invention to provide an integrated, stackable game-glass device with particular features to avoid the possibility of jamming any of the game elements while at the same time providing improved insulating properties to the glass portion.

These and other objects of the invention will become apparent in light of the present specification.

SUMMARY OF THE INVENTION

The present invention comprises a novelty game drinking glass device for containing beverages as well as entertaining, amusing and interesting a user both during and/or after the consumption of his beverage.

The invention comprises drink receptacle means having integrally formed and substantially transparent partition means. The partition means are positioned upwardly from the bottom end of the drink receptacle means to form a recess portion at the bottom end while segregating the beverage from this bottom recess portion. Novelty game means are positioned within the bottom recess portion so as to be visable by the user through the substantially transparent partition means. The novelty game means are further restrainably positioned within the recess portion of the drink receptacle means by recess closure means which also provide a liquid impervious seal to the bottom recess portion so as to preclude any undesireable leakage of liquids into this portion when the drinking glass is washed.

In the preferred embodiment of the invention the drink receptacle means and the partition means comprise an integrated, single, one-piece molded unit most desireably formed or molded from a substantially transparent acrylic plastic material.

One embodiment of the novelty game means utilizes one or more six-sided cube dice elements with game indicia on each of the six sides. Felt fabric means on top of the recess closure means are utilized to support and cushion the cube dice elements so as to prevent the marring of the recess closure means by the dice element. The felt fabric means also reduce the noise produced by the dice when the dice are shaken by a user to obtain different combinations of indicia, as viewed by the user through the substantially transparent partition means. Additionally, the felt fabric means also form a background for viewing the game indicia in order to facilitate distinguishing them by the user. Most preferably, the felt fabric means is affixed to the top of the recessed closure means by adhesive material.

In this particular embodiment of the novelty game means, the partition is preferably positioned above the felt fabric means on the recess closure, at a distance of from 1.45 to 1.75 times the length of the cube dice element side, so as to allow rotation of each of the plurality of cube dice elements about their respective axis within the recess portion while precluding the rotation of one entire cube dice element over another cube dice element. Such a structure avoids any possibilities of jamming the cube dice elements within the recess portion between the partition and the felt fabric means.

In yet another embodiment, the novelty game means comprises ball-placement game means which utilize a moveable ball within the recess portion together with ball-field means positioned on top of the recess closure towards which supporting the moveable ball means. The ball-field means comprises an elevated sculptured element having planar surface portions on which the ball may move, and crevice portions into which the ball may fall as a result of movement imparted to the ball by the user. Additionally, each of the crevice portions has an indicia element associated therewith which the user may alternatively desire or not desire the ball to be deposited in and associated with. For example, if a point range is utilized as part of an indicia element, the user would undoubtedly prefer that the ball fall into the crevice marked with a higher game value rather than seeing the ball fall into a crevice marked with a substantially lower ball value. In the preferred embodiment this elevated sculptured element comprises a vacuum-formed member.

Preferably, the indicia elements are embodied by a graphic card aligned with the planar surfaces and crevices of the sculptured element. The graphic card has the indicia elements fabricated thereon for association with the respective planar surfaces and crevices, and the sculptured element itself is substantially transparent so that when the graphic card is in position under the sculptured element, it may be viewed by a user through the sculptured element and in turn through the transparent partition means. This graphic card is positioned and restrainably maintained within the lower portion of the sculptured element through the utilization of a shoulder as well as bump extensions fabricated into the sculptured elements between which the edges of the graphic card is sandwiched. The card is appropriately aligned with the sculptured element through the utilization of one or more notches in the graphic card and one or more keys in the sculptured element whereby the respective notches and keys nest.

Additionally, the sculptured element has a plurality of protuberances about a lower flange portion which assists in centering and gripping the peripheral edge of the recess portion immediately surrounding the sculptured element.

In one embodiment of the ball-placement type game, the planar surfaces comprise a plurality of downwardly sloping ramps leading to a respective series of associated crevices. The respective crevices are separated from closely adjoining crevices by partition ridges so as to be capable of directing the moveable ball from the periphery of the recess portion towards one of many crevices after the ball has been rotated around and about the inner periphery of the recess portion by the user.

In another embodiment of ball placement type game, the planar surfaces are substantially horizontal whereby the user attempts to direct the moveable ball into a particular crevice by carefully tilting the drinking glass device in any one of a number of various directions.

The recess closure means comprises a plug assembly capable of being telescopically received by the bottom of the recess portion. The bottom of the plug has a downwardly flanged portion comprising an integrated coaster for utilization with the novelty game drinking glass device. Additionally, this downwardly flanged portion of the recess closure means is capable of being telescopically received in a close fashion by the top of the drink receptacle means of an equivalent glass device to impart the capability of stacking between such equivalent glass devices.

In another embodiment of the invention, the recess closure means are capable of being removed with substantial ease to enable interchangeability of a variety of novelty game means for positioning within the more or less standardized bottom recess portion.

The present invention further includes a method for fabricating such a novelty game drinking glass device. The method comprises the steps of (1) telescopically inserting the game means into the bottom recess portion, (2) inserting the recess closure means into the bottom of the recess portion into a tight interference fit within the recess portion, (3) simultaneously forcing the recess closure into close proximity with the receiving shoulder of the bottom recess portion while sonically vibrating a portion of the receiving shoulder so as to liquify that portion which, in turn, forms a seal between the shoulder and the closure means, and (4) curing the formed seal to restrainably grip the recess closure means to thereby preclude inadvertent separation of the recess closure means from the bottom recess portion.

In the preferred embodiment of the method that portion of the shoulder which is vibrated comprises a V-shaped protrusion ring which emanates from the shoulder and which liquifies upon the application of the sonic vibrations so as to allow close juxtaposition of the closure means with the shoulder.

DETAILED DESCRIPTION OF THE DRAWINGS

Figure 1:
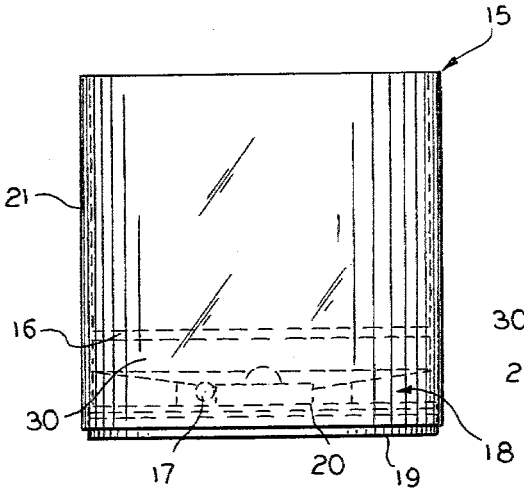
FIG. 1 of the drawings is a front elevational view of the novelty game glass device showing particularly the location of the partition and novelty game means located thereunder.

While this invention is susceptible of embodiment in many different forms, there is shown in the drawings and will herein be described in detail several specific embodiments, with the understanding that the present disclosure is to be considered as an exemplification of the principles of the invention and is not intended to limit the invention to the embodiments illustrated.

Novelty game glass device 15 is shown in FIG. 1 as being formed by drink receptacle 21 with partition 16 so as to form recess portion 30. Game means 18 with graphic card 20 is restrainably positioned within recess portion 30 and maintained in place by recess closure means 19.

Figure 2:
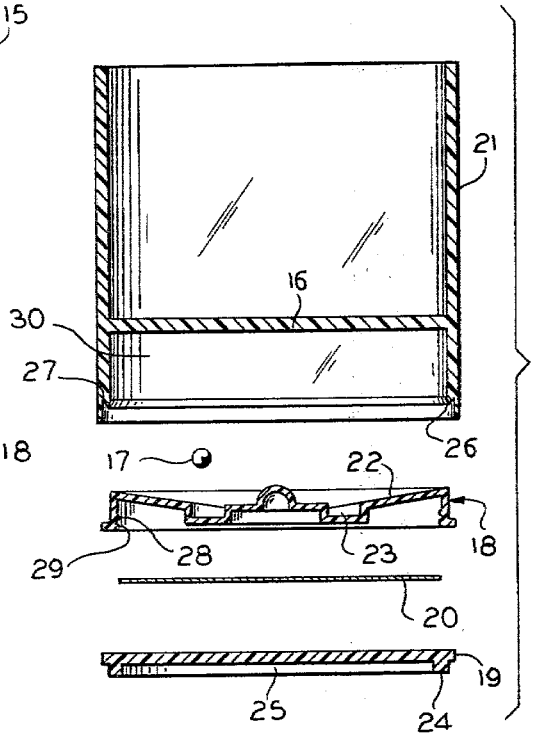
FIG. 2 is a front exploded cross sectional view of the invention showing its particular structural features including the drink receptacle means, partition means, novelty game means and recess closure means.

The exploded view of FIG. 2 shows particularly, in cross sectional view, drink receptacle 21, partition 16, and recess portion 30 formed just under partition 16. V-shaped protrusion ring 26 emanating from shoulder 27 is also shown in FIG. 2 although after fabrication of the device, this V-shaped portion of the shoulder would be liquified to provide the beneficial sealing characteristics previously described. Sculptured element 18, here a vacuum-formed elevated field, has planar surface ramp 22 and crevice 23. Ball 17 is placed upon the surface to be capable of rotation around the interior periphery of recess portion 30 after which it is directed downwardly towards one of the available crevices such as crevice 23. Bump extension 29 and shoulder 28 facilitate snap-in attachment of graphic card 20. The entire novelty game portion of the device is restrainably maintained in position within the recess portion through the positioning and affixation of closure means 19 having downwardly extended flange 24 and flange recess 25.

Figure 3:
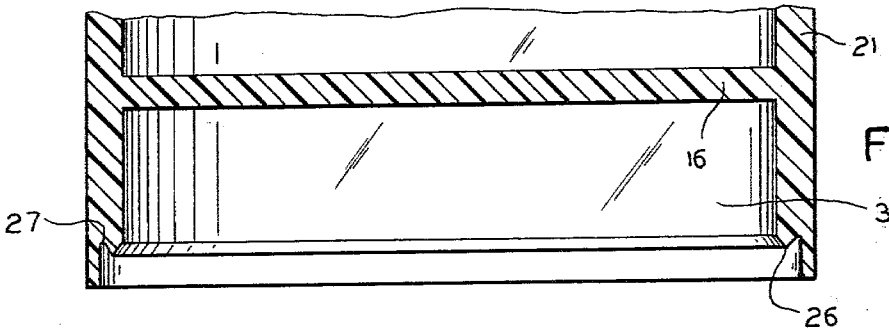
FIG. 3 is a front cross sectional view of a portion of the invention showing particularly the shoulder and V-shaped protrusion ring emanating from the shoulder surrounding the recess portion.

An enlarged view of the recess portion of FIG. 2 is shown in FIG. 3 in which drink receptacle 21 partition 16 and recess portion 30 is particularly shown. Also emphasized is V-shaped protrusion ring 26 emanating from recess portion shoulder 27. During the fabrication of the novelty drinking glass device, as the recess closure means is abutted up to shoulder 27 sonic vibrations are utilized to liquify the V-shaped protrusion in order to appropriately seal the space between the closure means and the shoulder so as to make the recess portion impervious to leakage.

Figure 4:
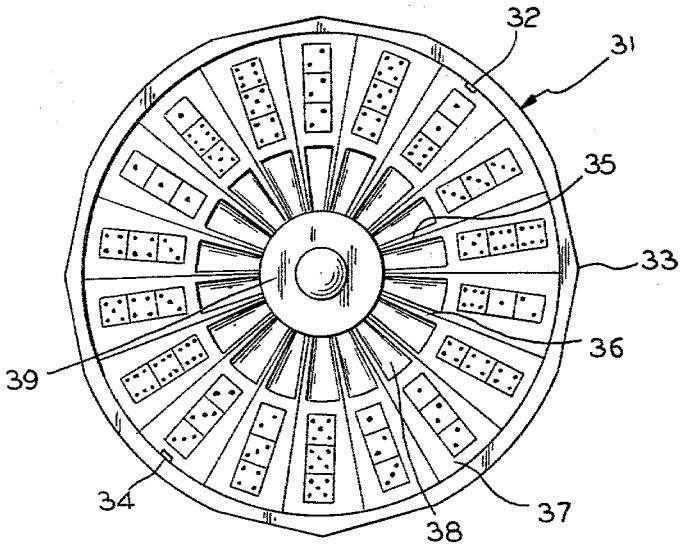
FIG. 4 is an overhead plan view of one embodiment of the sculptured element means and graphic card located thereunder.

Sculptured element 31 is shown in FIG. 4 having an interior elevated portion and an outer flange portion for facilitated affixation into the novelty game glass device. Partition ridges 35 and 36 are also shown as separating the crevices so that a ball rotated about the inner periphery of the recess portion will move along the outer ramped planar surface and finally fall into one of the crevices and slots described thereby, relating to a particular graphic representation or score. Keys 34 and 32 are aligned with equivalently shaped notches in the graphic card inserted into the bottom portion of the sculptured element, so that the particular alignment of the card with the sculptured element may be easily achieved.

Figure 5:
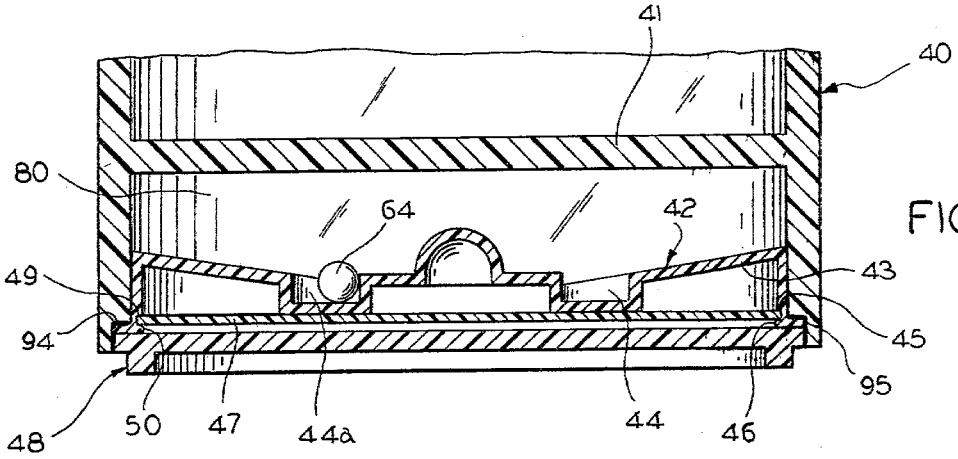
FIG. 5 is a front cross sectional view of one embodiment of ball-placement game in which downwardly sloping ramps lead to a series of associated crevices.

In FIG. 5 the planar surfaces and crevices define a ramp-type game in which ball 64 is initially rotated around the periphery recess portion 80 and, as it loses momentum, it rolls inwardly as it revolves along ramped surface 42. When yet more momentum is given up by the ball, it eventually falls into one of the crevices such as crevice 44 or **44*a* which has a particular game score value described for it by graphic card 47. As sculptured element 43, in the preferred embodiment, is a substantially transparent vacuum form, the graphics incorporated onto graphic card 47 are easily distinguishable to an observer both through the sculptured element, and in turn, through the substantially transparent partition 41. Shoulder 49 with bump extension 50 are utilized in the embodiment shown to enable "snapping in" of the graphic card within the bottom cavity formed by the elevated sculptured element. Thus card 47 itself is preferably not in direct contact with recess closure means 48. Bump extensions 46 and 50 are, preferrably, not continuous although shoulder 45–49 is continuous; in order to facilitate the snap positioning of the graphic card. From previous discussion it should be realized that the V-shaped protuberance emanating from the recess portion shoulder has been liquified by previously-mentioned sonic vibrations so as to form seal 94–95 where sculptured element 42 and closure means 48 meet with the bottom of the recess portion 80**.

Figure 6:
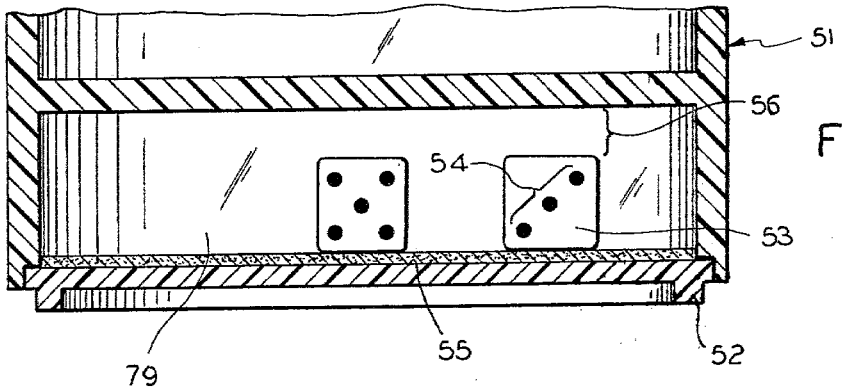
FIG. 6 is a front cross sectional view of the novelty game embodiment in which cube dice elements are utilized within the recess portion.

The cube dice game embodiment of the invention 51 is shown in FIG. 6. Cube dice element 53 by example, is positioned within recess portion 79 and cushioned from closure means 52 by felt fabric 55. It should be noted that the distance 56 above the deposited cube dice elements is preferably in the range of 1.45 to 1.75 times the length dimension of any one of the sides of the cube. This allows the cubes themselves individually to rotate about their own respective axes and makes impossible the rotation of one cube over another between the felt fabric and the partition so that jamming will not occur. Indicia 54 is shown on cube dice element 53.

Figure 7:
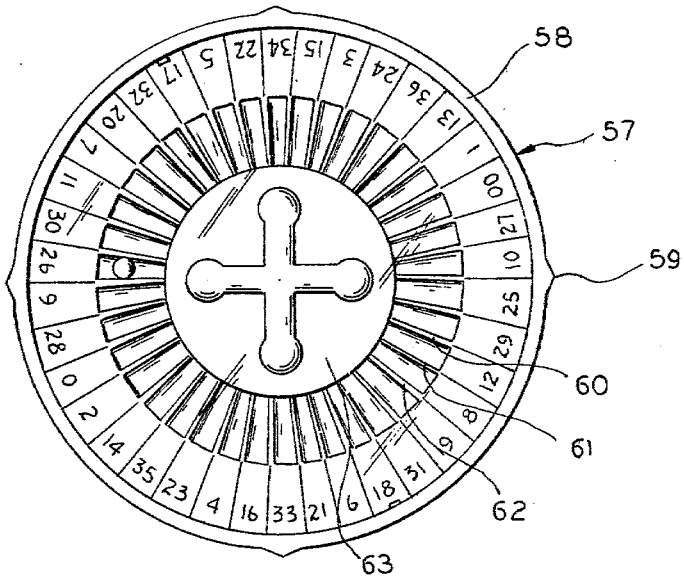
FIG. 7 is an overhead plan view of another form of sculptured element and graphic card utilizing ramps leading to crevices.

A second embodiment of the ramp-type bearing game is shown in FIG. 7 in which the sculptured element 57 has outer peripheral flange 58, protuberances such as protuberance 59 to help locate, center and maintain the sculptured element in place until the closure means is attached, and center stopping portion 63. Partition ridges 60, 61 and 62 are utilized to separate the particular crevices. Various color arrangements and graphical numerals such as the numbers shown in FIG. 7 are, in the preferred embodiment, incorporated onto the graphic card located directly beneath and within the bottom portion of sculptured element 57.

Figure 9:
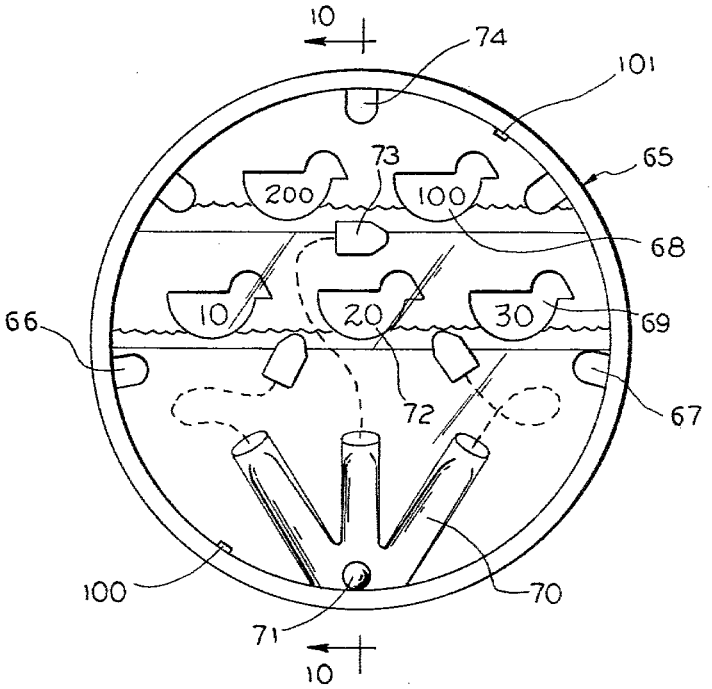
FIG. 9 is an overhead plan view of the sculptured element and graphic card means of the game embodiment relying upon a horizontal planar surface.
Figure 10:
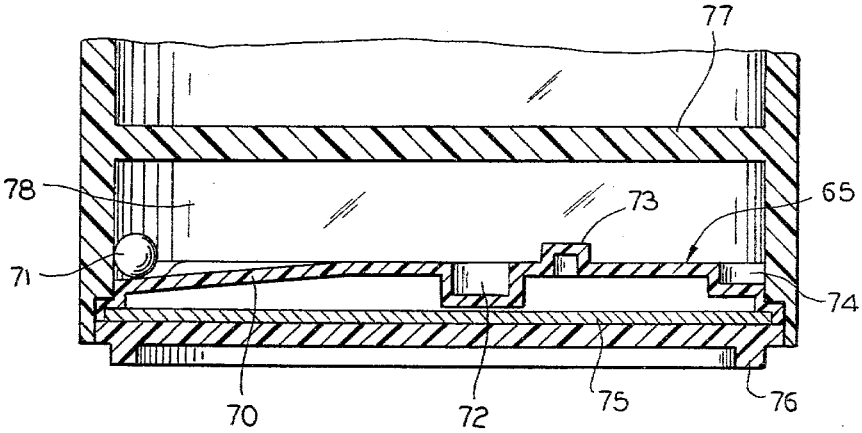
FIG. 10 is a front cross sectional view taken along lines 10—10 of FIG. 9 and looking in the direction of the arrows showing in detail the utilization of horizontal planar surfaces, and associated crevices.

The sculptured element of the substantially horizontal planar surface embodiment game is identified by reference numeral 65 of FIG. 9. Keys 100 and 101 fit into equivalent notches on the graphic card immediately received in the bottom of the sculptured element 65. Crevices 66, 67, 68, 69, 72, and 74 are given values or no values by the graphic card therebehind so as to describe an objective to which the user directs ball 71 to increase his "score." Abutments such as abutment 73, may be included to make more difficult the achievement of a high score. In this particular horizontal planar surface game a starting position has been incorporated through the utilization of planar ramp type surface 70. In the cross sectional view of FIG. 10, partition 77, abutment 73, crevices 72 and 74, ball 71, and ramp 70 are shown within recess portion 78. Also shown is the recess closure means 76 in position abutting game means 65.

Figure 11:
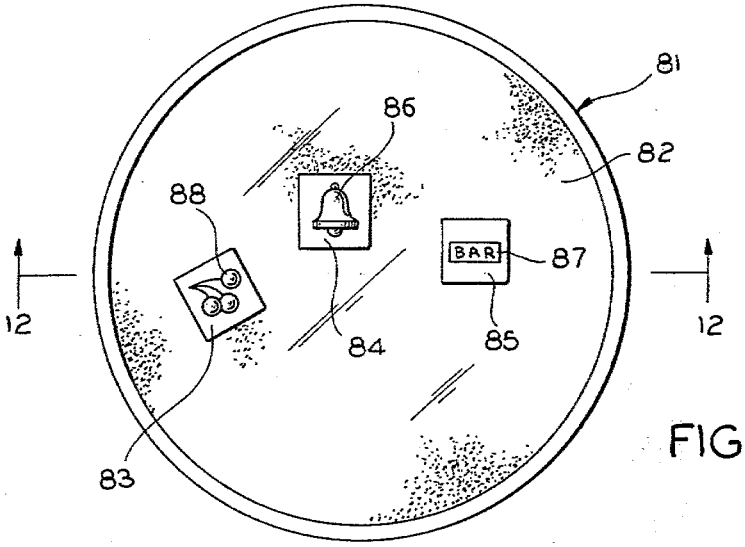
FIG. 11 is an overhead view of the cube dice element game embodiment.
Figure 12:
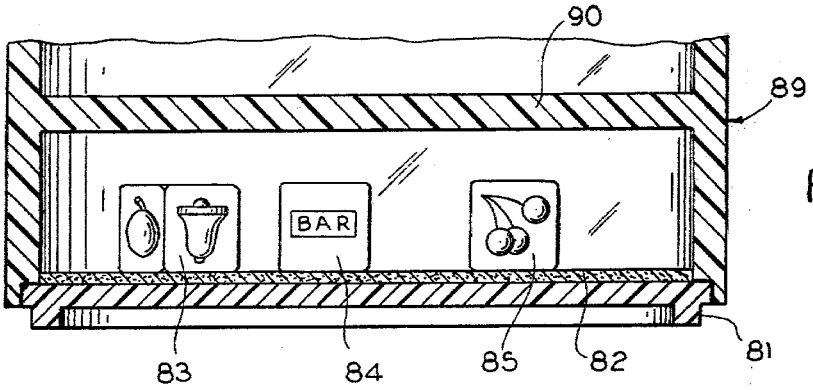
FIG. 12 is a front cross sectional view taken along lines 12—12 of FIG. 11 and looking in the direction of the arrows in which the particular configuration within the recess portion for such a cube dice game is shown.

An overhead and a front cross sectional illustration of the cube dice game is shown in FIGS. 11 and 12. Recess closure means 81 supports felt fabric 82 as well as cube dice elements 83 through 85 having indicia 88, 86 and 87 respectively.

Figure 8:
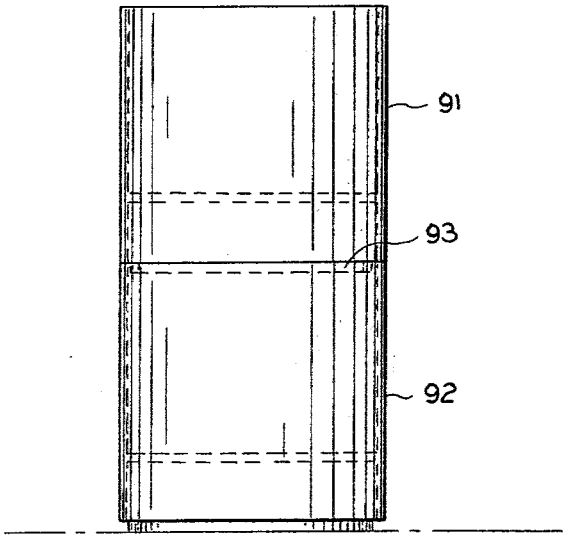
FIG. 8 is a front elevational view of two stacked glass devices relying upon the stacking features provided by the recess closure means.

Two stacked novelty game glass devices 91 and 92 are shown in FIG. 8 in which the flange disc 93 formed by the downwardly flanged portion of the closure means of glass 91 facilitates the stacking feature.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A novelty game drinking glass device for containing beverages as well as entertaining, amusing and interesting a user, said device comprising:

drink receptacle means having integrally formed and substantially transparent partition means, said partition means being positioned upwardly from the bottom end of said drink receptacle means to form a bottom recess portion at said bottom end, said partition means segregating said contained beverage from said bottom recess portion, novelty game means positioned within said bottom recess portion and positioned so as to be visible by said user through said substantially transparent partition means, said novelty game means restrainably positioned within said recess portion of said drink receptacle means by recess closure means, said recess closure means additionally providing a liquid impervious seal to said bottom recess portion so as to preclude the undesirable leakage of liquids into said bottom recess portion when said drinking glass device is washed;

said novelty game means comprising ball placement game means including moveable ball means within said recess portion, ball field means positioned substantially on top of said recess closure means which support said moveable ball means, said ball field means comprising a transparent elevated sculptured element having planar surface portions on which said ball may move and crevice portions into which said ball may fall as a result of movement imparted to the ball by the user, at least one indicia associated with said sculptured element, said indicia further being associated with a planar surface portion, or with a crevice portion which the user may desire or not desire said ball to be deposited therein, said indicia being embodied by graphic card means having means cooperating with said sculptured element for alignment of said indicia with said planar surface portions and said crevices of said sculptured element and positioned under said sculptured element, all of said indicia on said graphic card means being wholly visible through said sculptured element and in turn said substantially transparent partition means.

2. The invention according to claim 1 in which said drink receptacle means and said partition means comprise a single one-piece molded unit.

3. The invention according to claim 2 in which said one piece receptacle-partition unit is molded of a substantially transparent acrylic plastic material.

4. The invention according to claim 1 in which said elevated sculptured element comprises a vacuum-formed member.

5. The invention according to claim 1 in which said graphic card means is positioned and restrainably maintained within said sculptured element through the utilization of a shoulder and bump extensions in said sculptured element between which said graphic card means is sandwiched, and said means cooperating with said sculptured element comprising one or more notches in said graphic card means and one or more keys in said sculptured element, said respective notches and keys nesting.

6. The invention according to claim 1 in which said sculptured element has a plurality of protuberances about a lower flange portion which assists in centering and gripping the peripheral edge of said recess portion.

7. The invention according to claim 1 in which said planar surfaces comprise a plurality of downwardly sloping ramps leading to a respective series of associated crevices, said ramps and respective crevices being separated from closely adjoining ramps and crevices by partitioned ridges so as to be capable of directing said moveable ball from the periphery of said recess portion towards one of many crevices, after said ball has been rotated around and about the inner periphery of said recess portion by said user.

8. The invention according to claim 1 in which said recess closure means comprises a plug assembly capable of being telescopically received by the bottom of said recess portion.

9. The invention according to claim 8 in which the bottom of said plug assembly has a downwardly flanged portion, said downwardly flanged portion comprising a coaster for utilization with said novelty game drinking glass device.

10. The invention according to claim 9 in which said downwardly flanged portion of said recess closure means is capable of being telescopically received in close fashion by the top of the drink receptacle means of an equivalent device to impart the capability of stacking between such equivalent glass device.

11. The invention according to claim 1 in which said recess closure means are capable of being removed with substantial ease to enable interchangeability of a variety of novelty game means for positioning within said bottom recess portion.

12. The invention according to claim 1 in which said elevated sculptured element comprises a substantially hollow continuous formed member of a plastic material, said member having a substantially equivalent thickness over its planar surface and crevice portions so as to minimize and preclude visual distortion of said graphic card means positioned thereunder.

* * * * *